United States Patent [19]

Lofthus

[11] Patent Number: 4,971,304

[45] Date of Patent: Nov. 20, 1990

[54] APPARATUS AND METHOD FOR COMBINED DESKEWING AND SIDE REGISTERING

[75] Inventor: Robert M. Lofthus, Honeoye Falls, N.Y.

[73] Assignee: Xerox Corporation, Stamford, Conn.

[21] Appl. No.: 940,318

[22] Filed: Dec. 10, 1986

[51] Int. Cl.[5] ..... B65H 7/02

[52] U.S. Cl. ..... 271/227; 271/236; 271/250; 271/265; 198/415; 198/395; 198/460

[58] Field of Search ..... 271/227, 229, 236, 250, 271/251, 265, 202, 270; 198/415, 395, 460, 434; 355/145 H, 3 SH

[56] References Cited

U.S. PATENT DOCUMENTS

| | | | |
|---|---|---|---|
| 1,951,901 | 3/1934 | Cottrell | 271/58 |
| 2,407,174 | 9/1946 | Oberender | 271/2 |
| 3,131,931 | 5/1964 | Fechkowsky | 271/48 |
| 3,240,487 | 3/1966 | Templeton | 271/53 |
| 3,360,262 | 12/1967 | Kekopoulos et al. | 271/63 |
| 3,368,726 | 2/1968 | Funk et al. | 226/17 |
| 3,525,872 | 8/1970 | Schneider | 250/219 |
| 3,603,446 | 9/1971 | Maxey et al. | 198/33 |
| 3,758,104 | 9/1973 | Daily | 271/75 |
| 3,883,134 | 5/1975 | Shinaki | 271/261 |
| 3,897,945 | 8/1975 | Faltot et al. | 271/227 |
| 4,082,456 | 4/1978 | Schroter | 355/109 |
| 4,155,440 | 5/1979 | Bogdanski et al. | 198/399 |
| 4,216,482 | 8/1980 | Mason | 346/129 |
| 4,310,236 | 1/1982 | Connin | 355/14 SH |
| 4,438,917 | 3/1984 | Janssen et al. | 271/227 |
| 4,500,086 | 2/1985 | Garavuso | 271/225 |
| 4,511,242 | 4/1985 | Ashbee et al. | 271/227 |
| 4,519,700 | 5/1985 | Barker et al. | 271/270 |

FOREIGN PATENT DOCUMENTS

| | | |
|---|---|---|
| 1028495 | 4/1958 | Fed. Rep. of Germany . |
| 52-20562 | 2/1977 | Japan . |
| 54-149175 | 11/1979 | Japan . |

OTHER PUBLICATIONS

"Means to Correct Document Skew", Research Disclosure; Nov. 1979, pp. 642–643, No. 18759.

*Primary Examiner*—H. Grant Skaggs
*Attorney, Agent, or Firm*—Costello. Mark

[57] ABSTRACT

A method and apparatus for an improved active sheet registration system which provides deskewing and registration of sheets along a paper path in X, Y and Θ directions. Sheet drivers are independently controllable to selectively provide differential and non-differential driving of the sheet in accordance with the position of the sheet as sensed by an array of at least three sensors. The sheet is driven non-differently until the initial random skew of the sheet is measured. The sheet is then driven differentially to correct the measured skew, and to induce a known skew. The sheet is then driven non-differentially until a side edge is detected, whereupon the sheet is driven differentially to compensate for the know skew. Upon final deskewing, the sheet is driven non-differentially outwardly from the deskewing and registration arrangement. A fourth sensor may be provided to measure the position of the sheet after registration with respect to desired machine timing.

24 Claims, 4 Drawing Sheets

APPARATUS AND METHOD FOR COMBINED DESKEWING AND SIDE REGISTERING

This invention relates generally to the deskewing and side registering of a sheet moving in a process direction, and more particularly to removing an initial random skew by inducing an alignment skew, and compensating for that alignment skew so as to side register and deskew the sheet.

BACKGROUND OF INVENTION

Traditionally, paper handling devices of the type including xerographic reproduction machines have incorporated some sort of registration system to properly align sheets of paper passing through these devices. Whether the sheet is a document in a recirculating document handler or a copy sheet in the reproduction processor, registration or alignment of the sheets traveling through a paper path to a known orientation is necessary for the achievement of high quality copying. With particular reference to the reproduction processor, it will be appreciated that registration of copy sheets must include, for example, synchronization of the copy sheet edges with the latent image on the photoreceptor, as well as speed matching with the photoreceptor and transportation of the sheet into the transfer zone (herein defined as registration in the process direction or registration in the X-direction), side registration (herein defined as registration in a direction perpendicular to the path of sheet travel or registration in the Y-direction), or deskewing of improperly fed copy sheets (herein defined as deskewing or registration in the Θ direction).

In the past, alignment systems have been primarily passive, making use of physical contact with the sheet for alignment generally by providing a fixed position contacting registration member at an appropriate position for a selected registration operation. Such contacting members have included gripper bars, side guides, tamper arrangements, stalled rolls and/or registration fingers. A common weakness in all these devices is the inherent relative motion between the registration member and the sheet during contact. Contact and slippage between registration member and sheet can cause unacceptable damage to the sheet edge, and potential jamming of the machine. In certain finger registration systems, misfeeding may lead to tearing, ripping or holing of the sheet, particularly problematic when handling originals. Additionally, long term contact between passing sheets and the registration member may cause wear of the registration member, leading to long term variance in registration, thereby requiring adjustment or repair of the mechanical members to obtain original registration accuracy. These arrangements often also require extended paper paths to be effective.

Use of active driving arrangements to alter the orientation of objects such as a flimsy sheet of paper, cardboard or cloth, by providing differentially driven driving members are known, as shown by, for example, U.S. Pat. Nos. 2,407,174 to Oberender; 3,758,104 to Dailey; 4,155,440 to Bogdanski et al; 3,131,931 to Fechowsky; 3,240,487 to Templeton; 3,897,945 to Faltot et al; 4,082,456 to Schröter; 4,500,086 to Garavuso; "Means to Correct Document Skew", Research Disclosure, November 1979, pp. 642–643, No. 18759; and West German Patent No. 1,028,945. Some of positive driving arrangements are provided with sensors to sense position of the objects, to deskew or position the objects, such as for example, U.S. Pat. Nos. 3,525,872 to Schneider; 4,082,456 to Schröter; 3,360,262 to Kekopoulos et al; Japanese Kokai 54-149175 and Japanese Kokai 52-20562, which teach detection of lead edge skew, and U.S. Pat. Nos. 1,951,901 to Cottrel, 3*d;* 3,368,726 to Funk et al; and 3,603,446 to Maxey et al; 3,883,134 to Shinaki which teach detection of side edge registration.

Certain registration systems provide active registration devices which sense document position and operate to correct the positioning if necessary. With particular reference to U.S. Pat. No. 4,438,917 to Janssen et al., a sheet deskewing arrangement may be provided with a sensor set arranged along the path of sheets in the processing direction and a pair of selectably controllable motors, each driving a driving nip in a nip roll pair, supported to contact a side portion of the sheet in driving engagement, to correct skew sensed by the sensors. The two sensors, arranged in a line perpendicular to the path of sheet travel, each detect when the lead edge of a sheet passes thereby. A difference in sensing time of sheet passage by each sensor is indicative of sheet skew, and the two motors are driven in accordance with the difference to accelerate or decelerate a side portion of the sheet, thereby rotating the sheet to bring the lead edge of the sheet into registration. This arrangement provides satisfactory registration, when paper is fed to the deskewing area with an induced initial skew angle, within a predetermined range of angles and in an appropriate direction. Additionally, this type of arrangement is attractive from the point of view that misregistration or misfunctioning of the registration apparatus results only in a misregistered copy, and does not damage the sheet or machine. U.S. Pat. No. 4,216,482 to Mason, teaches a combination of a hard stopping pivot member and a positive driving arrangement, coupled with fixed and movable sensors to register a sheet.

SUMMARY OF THE INVENTION

It is accordingly an object of the invention to provide a sheet registration arrangement for deskewing and side registration of paper sheets along a sheet conveyor.

It is another object of the invention to provide a sheet deskewing and side registration arrangement useful in registration of sheets having unknown direction and amounts of skew.

It is still another object of the invention to provide a three-mode registration system which advantageously provides registration of sheets along a paper path in X, Y and Θ directions.

In accordance with the invention there is provided method and apparatus for an improved active sheet registration system which advantageously provides deskewing and registration of sheets advancing along a paper path in X, Y and Θ directions. The inventive system entails inducing a deliberate known amount of skew to a sheet having an unknown skew, entering a deskewing and registration arrangement, whereby the side edge of the sheet is placed into position for appropriate detection of orientation, and deskewing and registering the sheet from a known skew orientation rather than relying on probable position and orientation ranges.

In accordance with another aspect of the invention there is provided a method of combined sheet deskew and side registration comprising the steps of feeding a sheet with an unknown amount of initial random skew in a process direction into engagement with a sheet driver assembly comprising at least two spaced apart, independently controllable sheet drivers to selectively provide differential and non-differential driving force to the sheet; driving the sheet non-differentially in the process direction with the sheet driver assembly until the sheet reaches an initial skew sensor arrangement comprising spaced apart first and second sheet sensors; measuring the initial random skew of the sheet with the initial skew sensor arrangement; driving the sheet differentially with the driver assembly to both compensate for the initial random skew and induce an alignment skew of a predetermined magnitude; driving the sheet non-differentially in only the process direction with the driver assembly until a side edge of the sheet reaches a third sheet sensor; driving the sheet differentially with the driver assembly to compensate for the induced alignment skew whereby the lead edge of the sheet is registered to a lateral position transverse to the process direction and deskewed; and driving the sheet non-differentially in the process direction with the driver assembly.

In accordance with yet another aspect of the invention there is provided a sheet deskew and side registration apparatus for deskewing a sheet having a random initial skew and also side-registering that sheet to a lateral position along a process direction, including an initial skew sensor arrangement comprising first and second spaced apart sheet sensors located along a paper path for measurement of random initial skew of the sheet and a side edge sensor arrangement comprising a third sheet sensor for sensing the sheet side edge, a drive assembly comprising at least two independently controllable and spaced apart sheet drivers for driving sheets differentially and non-differentially and a controller for selectably controlling the operation of the drive assembly in accordance with the detection of selected sheet portions by the skew sensor and side edge sensor arrangements. In operation, the drive assembly drives sheets non-differentially in the process direction until the sheets reach the initial skew sensor arrangement which detects the passage of selected sheet portions thereby. In response to the difference between time of passage of the sheet portions by each of the deskew sensors, the deskew controller controls each driver assembly to differentially drive the sheet drivers to compensate for the initial detected random skew of the sheet and also to drive the sheet to a skew of a preselected magnitude. In response to detection of a side edge of the sheet by the third sheet sensor, the controller controls the drive assembly to differentially drive the sheet drivers to compensate for the induced skew, deskewing the sheet, and side registering the sheet to a selected position in the lateral direction. Upon lateral or side registration, the controller controls the drive assembly to non-differentially drive the sheet drivers to drive the sheet in the process direction. Depending on the application with which the deskewing and registration arrangement is used, the sheet may be non-differentially driven to a position for copying, receiving an image thereon, or to any other processing position requiring presentation of the sheet in a registered position.

In accordance with still another aspect of the invention, a fourth sheet sensor may be provided along the path of travel downstream from the above-described deskew and side registration arrangement for detecting the time of passage of the deskewed sheet thereby. The drive assembly may be non-differentially controlled to compensate for the position of the sheet with respect to the process direction.

These and other objects and advantages will become apparent as the following description is reviewed in conjunction with the accompanying drawings in which.

Figure 5:
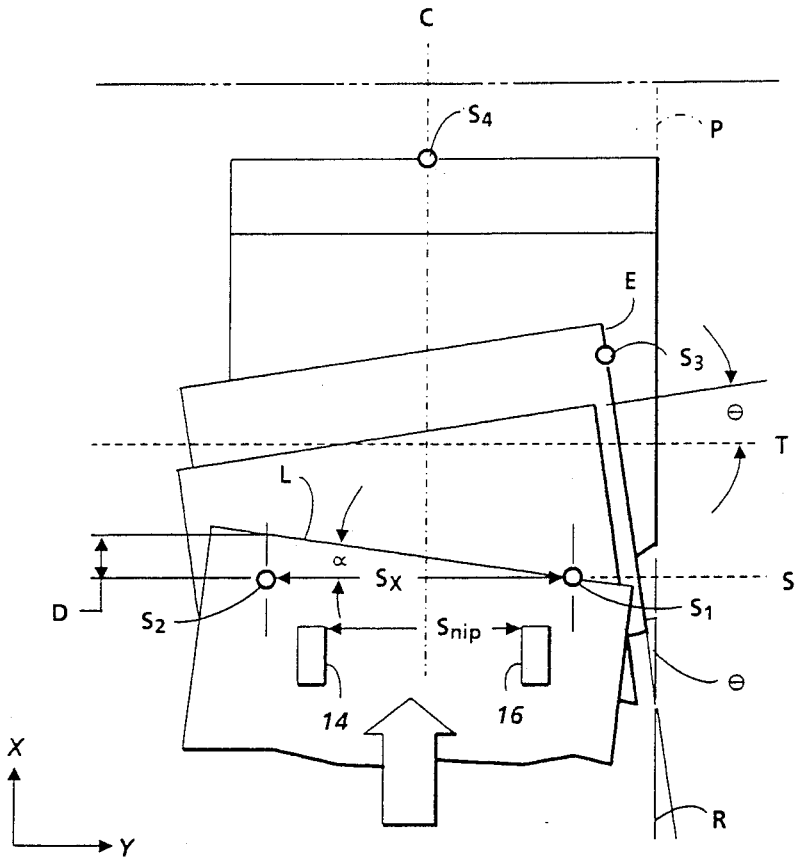
Figure 6:
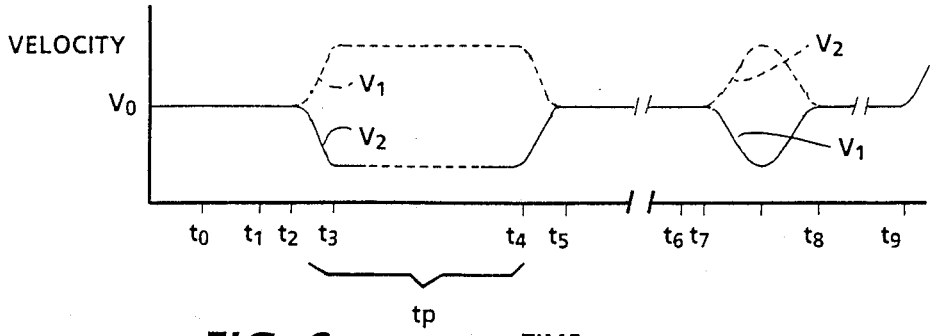

FIG. 5 demonstrates the movement of sheets through the deskewing and side registration arrangement; and FIG. 6 is a plot of velocity over time for the sheet drivers in the present invention.

Figure 1:
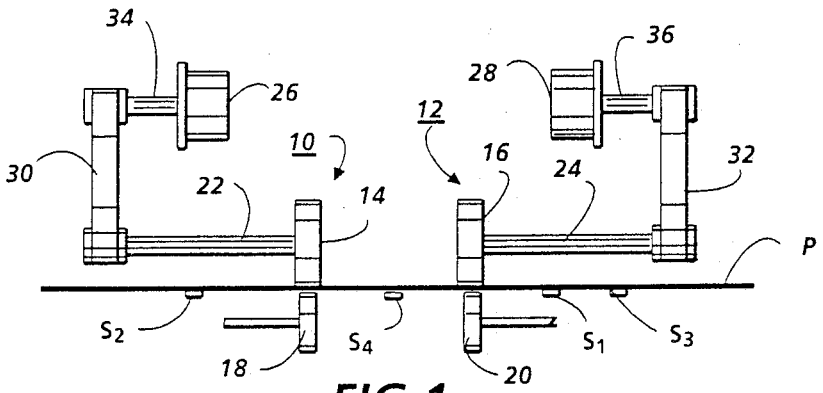
FIG. 1 shows a view along the paper path into a deskewing and side registration arrangement in accordance with the present invention.
Figure 2:
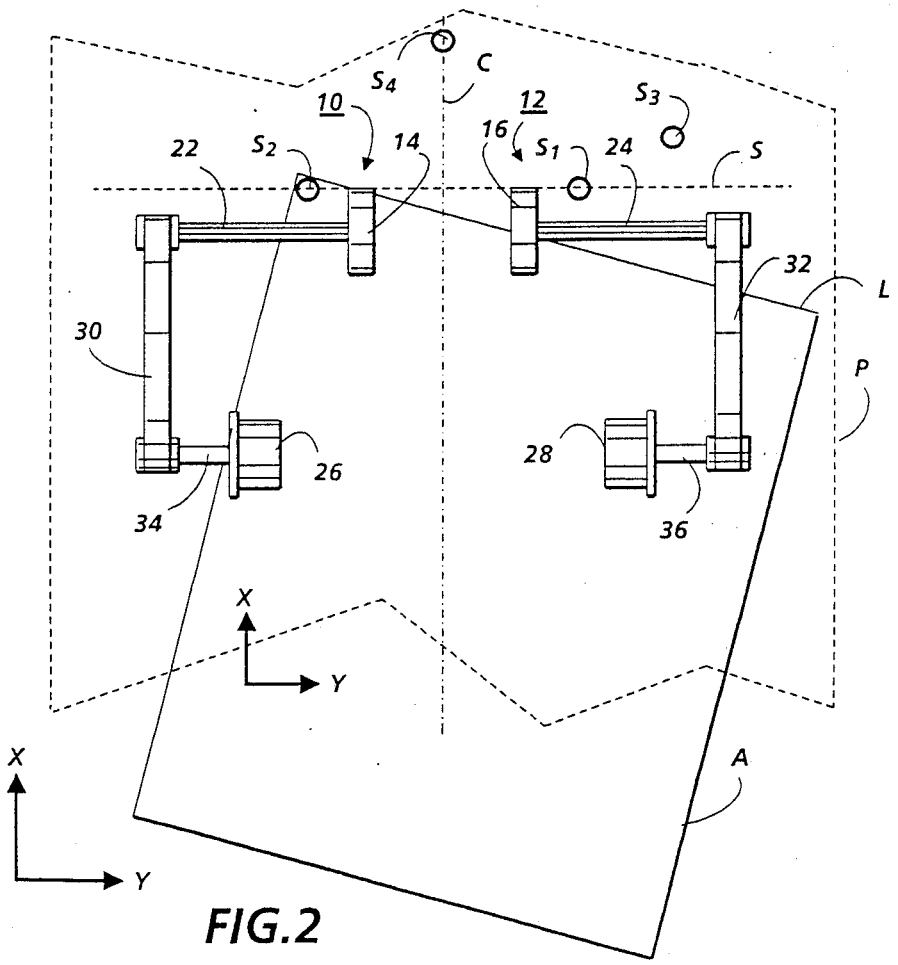
FIG. 2 shows a top view of the inventive deskewing and side registration arrangement, and the associated paper path.

Referring now to the drawings, wherein the showings are for the purpose of illustrating a preferred embodiment of the invention and not for the purpose of limiting same, FIGS. 1 and 2 show an arrangement incorporating the present invention. It will be appreciated that the present invention finds advantageous use in any application where discrete sheets of material must be registered and/or deskewed, such as, for example, a recirculating document handler handling original documents, a reproduction processor handling paper copy sheets or other final support surface, or any printing, copying, or document handling applications where the registration of such a discrete sheet is important. For the purposes of description, the handling of copy sheets in a reproduction processor will be described.

Sheet A is advanced along a paper path P, which may be any curvilinear surface over which paper sheets will be passed, into a pair of nip roll pairs 10 and 12, each respectively comprising driving rollers 14 and 16, and idler rollers 18 and 20, which frictionally engage sheet A therebetween. The driving and idler rollers are generally provided with a rubber or plastic surface suitable for substantially non-slipping engagement of sheets passed therebetween. Driving rollers 14 and 16 are respectively supported for controllable rotating driving motion on roller shafts 22 and 24. Roller shafts 22 and 24 are drivingly engaged to independently controllable drive means such as motors 26 and 28 via timing belts 30 and 32, supported one end on roller shafts 22 and 24, and at the other end on motor shafts 34 and 36, respectively. Motors 26 and 28 are generally similar in construction and operational characteristics, and in one particularly advantageous embodiment comprise stepper motors. One suitable stepper motor is a Sigma Corporation, Series 20 stepper motor having a resolution of 200 step/rev. This motor is only one example of many possible devices suitable for the intended application.

Paper path P is provided with a series of at least three sensors, $S_1$, $S_2$, $S_3$. Sensors $S_1$ and $S_2$ are suitably spaced on a line S arranged generally perpendicularly to the path of paper sheet travel (x-direction) along paper path P, slightly downstream from the nip roll pairs, advantageously spaced about 9 inches apart, and each spaced approximately equidistant from a paper path centerline C. Sensor $S_3$ is located at a position where one side edge of a paper sheet will pass, for detection by the sensor. In one embodiment, this may be the slightly downstream from sensors $S_1$ and $S_2$, between 1.5" and 2.0" further away form nip roll pairs 10 and 12 than the line S, and spaced about 5.5 to 6.0 inches from center line C. In one working example, sensor 3 was spaced 1.86 inches downstream from line S and 5.540 inches from center line C. It will be appreciated that what is necessary in the positioning of sensor $S_3$ is that the position allow detection of the sheet side edge subsequent to skew detection, and accordingly, upstream or downstream positions are well within the scope of the invention. In one embodiment of the invention, a fourth sensor $S_4$ may be spaced along the paper path about 5 inches downstream from the line S. All of the sensors may be advantageously comprised of reflective optical sensors which will produce a signal upon occlusion by paper sheets or the like. Other dimensions and positions of the sensors and nip roll pairs with respect to each other are possible. The above are given as examples only.

As sheet A enters the deskewing arrangement and is advanced through nip roll pairs 10 and 12, lead edge L occludes sensors $S_1$ and $S_2$. Which sensor is occluded first depends on the direction of skew of the sheet, and it is entirely possible that the sheet will occlude both sensors $S_1$ and $S_2$ substantially simultaneously, thereby indicating no skew in the sheet. In either event, on occlusion, the sensors pass a signal to a controller system as will be described.

Figure 3:
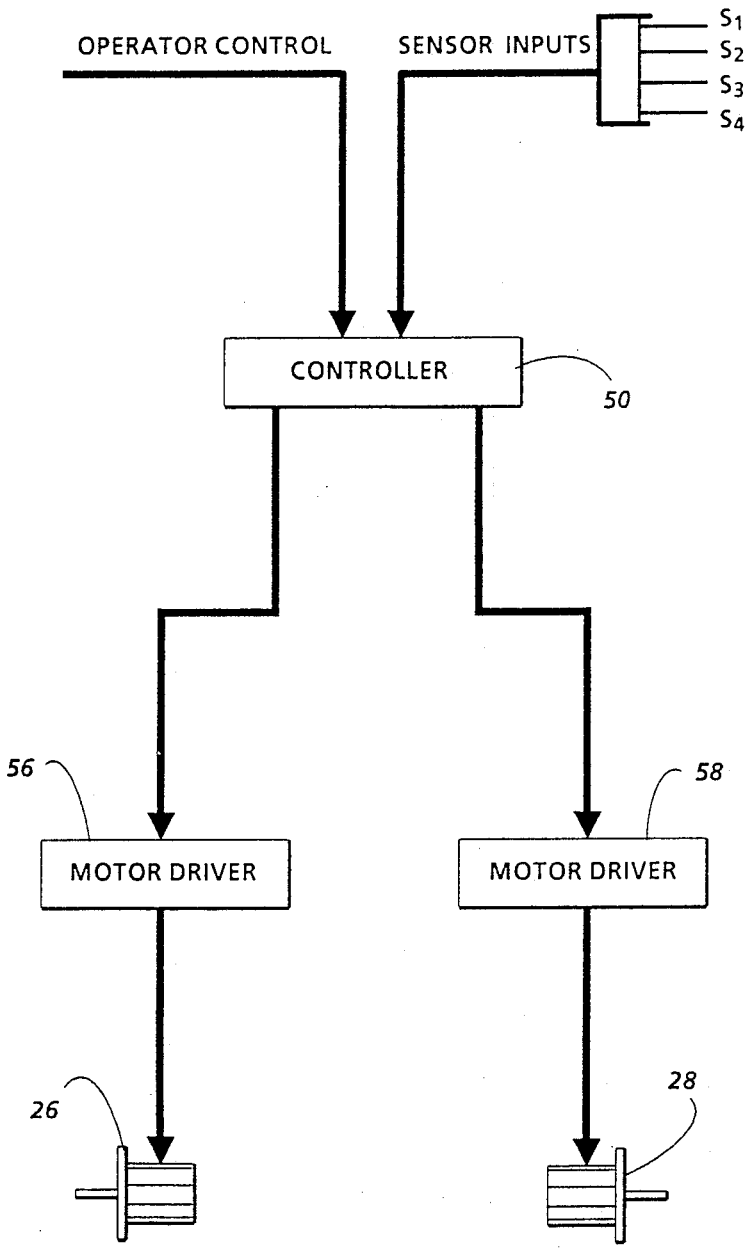
FIG. 3 shows the control arrangement for a preferred embodiment of the present invention.

Referring now to FIG. 3, a control system suitable for use in the present invention is shown. A controller 50 controls operations of the reproduction machine, or a portion thereof, as is well known in the art of reproduction machine control, and may be comprised of a microprocessor capable of executing control instruction in accordance with a predetermined sequence, and subject to sensed parameters, and producing a controlling output in response thereto. For the present invention, an Intel 8051 microcontroller is a satisfactory microprocessor for control of, for example, a sheet registration subsystem of a reproduction machine. Other alternatives are, of course, available.

Sensors $S_1$, $S_2$, $S_3$ and $S_4$ provide control signals to controller 50 to provide sensing information, from which information, operation of the driving rollers 14 and 16 will be controlled. Additionally, controller 50 drives motor driver boards 56 and 58. Motor driver boards 56 and 58 provide pulses to stepper motors 26 and 28 in accordance with the required movement and rotational velocity of driving rollers 14 and 16. In one typical example, stepper motors 26 and 28 are advantageously driven in a halfstep mode, although full step or microstep modes of operation could be used. Motor revolutions can thus be divided into a large number of halfsteps, each halfstep providing an exact increment of rotation movement of the motor shafts 34 and 36, and thus the driving rollers 14 and 16. In accordance with this scheme, motor driver boards 56 and 58 provide a pulse train to incrementally drive motors 26 and 28.

Figure 4:
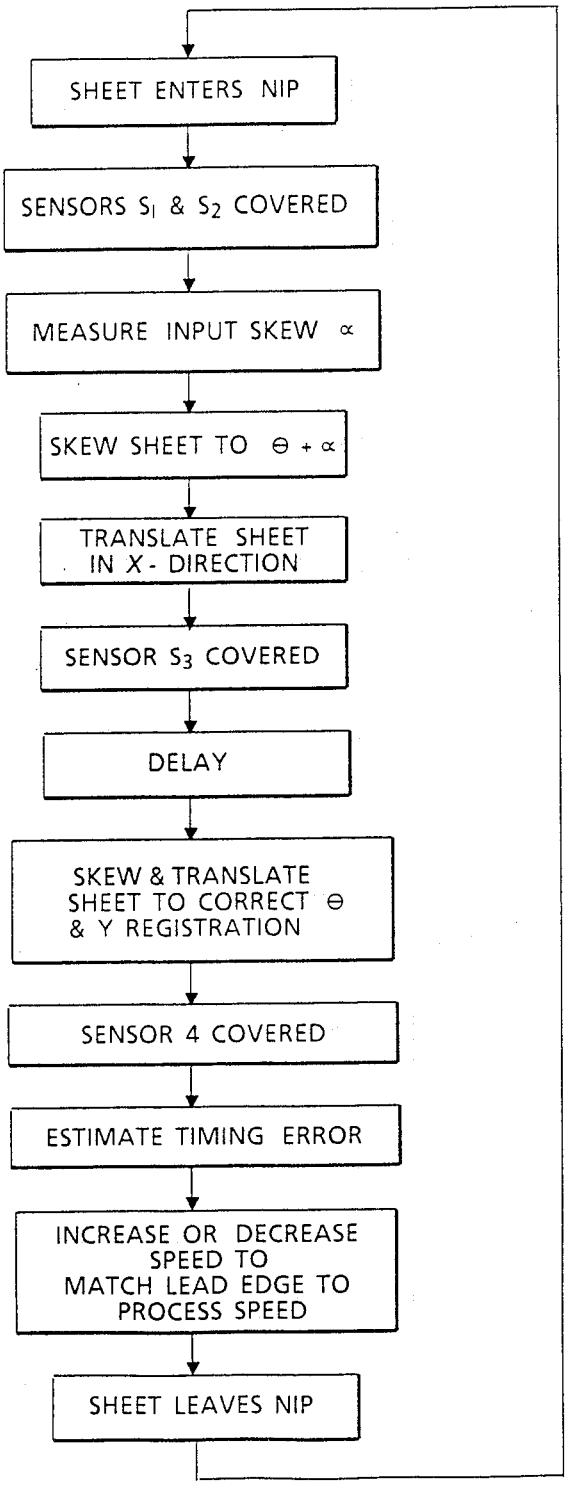
FIG. 4 is a flow chart showing the chain of operations in the the present invention.

In operation, the deskew arrangement operates in accordance with the flow chart of FIG. 4, with reference to FIG. 5, showing sheet position with respect to the sensors on path P. Briefly, sheet A having an unknown amount of skew a and unknown Y-direction position enters the deskewing arrangement, and after the unknown skew is measured by counting the motor halfsteps between occlusion of sensors $S_1$ and $S_2$, is rotated and translated along path P. The rotation of sheet A is to compensate for the skew a, and to impart an additional amount of skew to sheet A to produce a skew of $\theta$. After producing a skew of $\theta$, sheet A is advanced along paper path P until a side edge thereof occludes sensor $S_3$. Sheet A is then rotated and translated to remove skew $\theta$. Sheet A, now deskewed and registered in the Y-direction, is advanced along path P until it occludes a fourth sensor, and the sheets position with respect to time is compared to a desired value. The rate of advancement may be altered accordingly by changing the velocity of the motors 26 and 28, non-differentially.

The deskew and side registration process will now be described more specifically. Sheet A having an unknown amount of skew a enters the nip roll pairs 10 and 12 and is driven non-differentially thereby, at a constant velocity $v_0$. As it is advanced, lead edge L passes by and occludes either of sensors $S_1$ or $S_2$. For the purpose of the description, it will be assumed that $S_2$ is occluded by lead edge L first. Sensor $S_2$ provides an occlusion signal to controller 50, whereby, controller 50 commences counting the halfsteps generated by motor driver boards 56 and 58 as sheet A is driven non-differentially through the nips by motors 26 and 28, past sensor $S_2$, and recording the number of halfsteps counted until sensor $S_1$ also indicates occlusion by sheet lead edge L. As there is assumed to be a linear relationship between the number of motor halfsteps counted and travel by the sheet lead edge L, it can be seen that:

$$N=D/K \tag{1}$$

where,

N = Number of motor halfsteps;

K = A constant equal to the advancement of the driving roller surface for each motor halfstep; and D = The difference distance traveled by the portion of the sheet which originally occluded $S_2$ until $S_1$ is occluded.

Thus, it can also be seen that $$a=\tan^{-1}D/S_x \tag{2}$$

or for small angles $$a=D/S_x \tag{3}$$

where,

A = the random skew angle of a sheet entering the nips; and $S_x$ = distance between sensors $S_1$ and $S_2$.

Because K and $S_x$ are constants for a particular registration subsystem, a sufficient measure of the skew angle of the sheet as it enters the registration and deskewing arrangement is simply N, the number of motor halfsteps taken between occlusion of sensor $S_1$ and sensor $S_2$, while the motors are driven non-differentially. Similarly, because the distance in the Y direction between nip roll pairs 10 and 12 is constant for any particular registration system, a sufficient measure of the skew imparted to the sheet while motors 26 and 28 are driven differentially is the net difference in the number of halfsteps taken by each motor. The relationship between the initial skew angle a measured by counting motor halfsteps between occlusion of sensors $S_1$ and $S_2$ when sheet A enters the registration and deskewing arrangement with motors 26 and 28 driven non-differentially, and the skew angle imparted to sheet A when motors 26 and 28 are driven differentially can thus be expressed:

$$N_{diff} = N\frac{S_{nip}}{S_x} \quad (4)$$

where,

N=The initial skew angle as measured in motor halfsteps;

$N_{diff}$=The equivalent skew angle imparted during differential drive mode, as measured in motor halfsteps; and $S_{nip}$=The distance between nip roll pairs 10 and 12;

With the skew angle a of the sheet known, the sheet is rotated in a selected direction, for example counterclockwise, looking down on FIG. 5 to both compensate for the skew angle a and to add a variable amount of skew to yield a skew angle $\theta$ measured with respect to a line T, perpendicular to the process or x-direction. It will no doubt be appreciated that a congruent angle is thereby also imparted between the edge of sheet A and an line R disposed in parallel to the paper path P and spaced from the centerline C a predetermined distance. This rotation is accomplished simultaneously with continuing advancement along paper path P in accordance with the velocity diagram depicted in FIG. 6. In accordance with FIG. 6, it will be seen that at an initial $t_0$, when the sheet first enters the nips 10 and 12, both motors 26 and 28, are operating at substantially similar speed to drive the sheet non-differentially at a velocity $v_0$. At $t_1$, sensor $S_2$ is occluded by lead edge L of sheet A, while at $t_2$, sensor $S_1$ is similarly occluded. In accordance with the detected random skew angle a of the sheet, motor 28 is driven at an increased velocity $v_1$ while motor 26 is driven at a decreased velocity $v_2$. The acceleration and deceleration of motors 26 and 28 to their respective velocities is shown by the ramps occurring between $t_2$ and $t_3$. The motors 26 and 28 are then driven at $v_2$ and $v_1$, selected as constant velocities at the upper and lower optimum operating speeds for the selected motors for the period $t_p$, from $t_3$ to $t_4$, which period is determined by the detected angle a and the need to rotate the sheet to the preselected skew angle $\theta$.

The period of time $t_p$ that motors 26 and 28 are driven at speeds $v_2$ and $v_1$ is determined in the following manner. Let $N_{ramp}$ be the sum of the skew imparted to sheet A when motors 26 and 28 are ramping to speeds $v_2$ and $v_1$ from $v_0$ plus the skew imparted to sheet A when motors 26 and 28 are ramping from speeds $v_2$ and $v_1$ back to $v_0$. With reference to FIG. 6, $N_{ramp}$ is the skew imparted to the sheet during the time from $t_2$ to $t_3$ and from $t_4$ to $t_5$. Thus, given the desired angle $\theta$, the controller 50 counts the net difference in halfsteps taken by motors 26 and 28 at speeds $v_2$ and $v_1$, respectively. The net number of halfsteps to be taken when motors 26 and 28 are at speeds $v_2$ and $v_1$, respectively is calculated as $$N_{net} = N_\theta - N_{ramp} \pm N\frac{S_{nip}}{S_x} \pm N_{cor} \quad (5)$$

where $N_\theta$=The desired skew angle $\theta$ in motor halfsteps;

$N_{ramp}$=The sum of the skew (in motor halfsteps) imparted to sheet A when motors 26 and 28 are ramping to speeds $v_2$ and $v_1$ from $v_0$ plus the skew imparted to sheet A when motors 26 and 28 are ramping from speeds $v_2$ and $v_1$ back to $v_0$;

±N refers to an initial skew a in either the positive (clockwise) or negative (counterclockwise) directions (in the example, $S_2$ is occluded first, so that a is clockwise and the sign is positive); and $N_{cor}$=The desired correction in nominal skew, in motor halfsteps, where the sign depends on the direction of the correction, clockwise or counterclockwise.

To change the cross or side registration (y-direction) of a sheet, it is only necessary to delay the time from when the sensor $S_3$ is occluded by the sheet edge E at time $t_6$ to the time when the final deskew operation begins, at $t_7$. This delay will be counted in motor halfsteps steps by controller 50. Each additional motor halfstep delay will cause an incremental side shift of the Y registration datum by an amount given as follows:

$$\Delta y = K \tan\theta \quad (6)$$

Where

K=A constant equal to the advancement of the drive roll 14 surface for each motor halfstep.

In the same manner, registration in the x-direction, or process direction, can be changed by delaying the time $t_9$ by a variable number of motor halfsteps. Thus, variations of the registration of sheet A with respect to paper path P can readily be accomplished. These adjustments may be desirable and necessary to account for other registration errors elsewhere in the system.

After skew correction the sheet is driven non-differentially by the motors 26 and 28 away from the deskew area. In one embodiment of the invention, a fourth sensor S4 is provided downstream from the deskewing arrangement along paper path P. The time of occlusion of this sensor is sensed with respect to a machine norm, or the status of other machine processes, such as the position of the latent image on the photoreceptor, with respect to the transfer station. Knowing this comparison, at $t_9$ the non-differential driving velocity of motors 26 and 28 may be increased or decreased to appropriately register the sheet with a machine operation in the X-direction. It will, of course, be appreciated that this information is also derivable from already known information, i.e. the time of occlusion of S1, S2, and S3, as well as the driving velocities of the motors acting on the sheet. In FIG. 6, the velocity is shown increasing.

In still another embodiment of the invention, the deskewing may be done by a series of nip roller pair sets, similar to nip roll pairs 10 and 14, spread over a length of paper path. At particularly high sheet speeds, the paper may not be engaged with a single nip pair set long enough to correct for the initial skew, side register and then register the sheet in the process direction of the sheet. Accordingly, it is well within the scope of the invention to distribute skew correction and side registration at one set of nip rolls pairs and to accomplish process direction registration at a subsequent set of nip roll pairs along paper path P.

The invention has been described with reference to a preferred embodiment. Obviously, modifications will occur to others upon reading and understanding the specification taken together with the drawings. The described embodiments are only examples, and various alternatives, modifications, variations or improvements may be made by those skilled in the art from this teaching which are intended to be encompassed by the following claims.

I claim:

1. A method of combined sheet deskew and side registration comprising the ordered steps of:

driving a sheet having an unknown side-to-side registration position and an initial random angle of skew of unknown magnitude and direction non-differentially in a process direction with a sheet driver;

sensing and measuring said initial random skew of said sheet with an initial skew sensing means;

driving said sheet differentially for a first selected period with said sheet driver to both compensate for said initial random skew and induce an alignment skew of a predetermined magnitude and direction;

driving said sheet non-differentially in said process direction with said sheet driver for a second selected period;

sensing a side edge of said sheet with a side edge sensing means removed from said initial random skew sensing means;

driving said sheet differentially with said sheet driver to compensate for said alignment skew and deskew said sheet, whereby one edge of said sheet is side registered to a lateral position transverse of said process direction.

2. The method of combined sheet deskew and side registration of claim 1, wherein the said first and second periods are measured by counting motor halfsteps directed to said sheet driver.

3. The method of combined sheet deskew and side registration of claim 1, further comprising the additional steps of:

continuing driving said sheet non-differentially in only said process direction with said sheet driver;

sensing a leading edge of said sheet with a leading edge sensing means; and changing the rate of said driving in accordance with a time of sensing.

4. The method of combined sheet deskew and side registration of claim 1, further comprising the additional steps of:

continuing driving said sheet non-differentially in only said process direction with said sheet driver;

determining said sheet position in the process direction;

changing the rate of said driving in accordance with said determined position.

5. The method of combined sheet deskew and side registration of claim 1, further comprising the additional step of:

continuing driving said sheet non-differentially in said process direction with said sheet driver, towards a processing station which presents said sheet in deskewed and side registered position for reproduction processing operations thereon.

6. The method of combined sheet deskew and side registration of claim 1, further comprising the additional step of:

continuing driving said sheet non-differentially in only said process direction with said sheet driver.

7. The method of combined sheet deskew and side registration of claim 1 wherein said step of measuring said initial random skew of said sheet by sensing said sheet with said initial skew sensing means further comprises:

sensing the leading edge of said sheet with either of first and second sheet sensors;

sensing said leading edge of said sheet with the other of said first and second sheet sensors;

determining the distance of travel of said sheet between the sensing of said leading edge by said first sensor and the sensing of said leading edge by said second sensor; and determining said initial random skew from said distance of travel.

8. The method as defined in claim 7 wherein said distance of travel is measured by counting motor half-steps directed to said sheet driver.

9. The method as defined in claim 1 wherein said first selected period is operator variable to determine a final skew angle.

10. The method of combined sheet deskew and side registration of claim 1, wherein driving said sheet differentially with said sheet driver to both compensate for said initial random skew and induce a known skew of a fixed magnitude, further comprises:

driving said sheet with said sheet driver, said sheet driver having two separate driving members, with one of said two driving members driven at a higher speed than the non-differential speed, wherein said higher speed is greater than said non-differential speed by a predetermined amount;

driving said sheet with a second one of said sheet driving members at a lower speed than the non-differential speed, wherein said lower speed is less than said non-differential speed by said predetermined amount; and said differential driving occurring over a period determined from said initial random skew sufficient to compensate for said initial random skew and induce said known skew.

11. The method of combined sheet deskew and side registration of claim 10, further comprising the additional steps of:

driving said sheet non-differentially in said process direction until said sheet reaches a sheet sensing means comprising a fourth sheet sensor; and, changing the said driving operation in accordance with a time of sensing.

12. The method of combined sheet deskew and side registration of claim 1 wherein said non-differential driving for said second selected period is continuable after sensing said sheet side edge to control the side edge registration position.

13. A combination sheet deskew and side registration apparatus for deskewing and side-registering a sheet having an initial skew of unknown magnitude and direction and unknown side registration along a process direction, said apparatus comprising:

selectably controllable drive means for driving sheets in the process direction;

initial skew sensing means for detecting the initial random skew of sheets entering the apparatus;

side edge sensing means, removed from said initial skew sensing means, for sensing a side edge of a sheet; and control means for selectably controlling said drive means for driving said sheet differentially and non-differentially, said control means controlling said drive means for differential driving first in response to initial sensing by said initial skew sensing means to remove initial skew and induce alignment skew, and later in response to subsequent sensing by said side edge sensing means to remove alignment skew.

14. A combination sheet deskew and side registration apparatus as defined in claim 13 and including a fourth sensor for sensing position along the process direction, subsequent to sensing by said side edge sensing means.

15. A combination sheet deskew and side registration apparatus as defined in claim 13 wherein said control means determines sheet position in the process direction based on initial skew detection, side edge detection and the selectable control of said drive means.

16. The combination sheet deskew and side registration device of claim 13 wherein said control means controls said drive means to drive said sheet non-differentially in said process direction towards a subsequent reproduction processing station in deskewed and side registered position for subsequent processing thereof.

17. The combination sheet deskew and side registration apparatus of claim 13 wherein said drive means comprises at least two independently controllable and spaced apart sheet drivers selectably controllable by said control means for driving said sheet differentially and non-differentially.

18. The combination sheet deskew and side registration apparatus of claim 17 wherein each sheet driver comprises a stepper motor separately driving a frictional sheet feeder.

19. The combination sheet deskew and side registration apparatus of claim 13 wherein said initial skew sensing means comprises first and second sheet sensors for sequentially sensing a lead edge of said sheet to determine initial skew.

20. The combination sheet deskew and side registration apparatus of claim 13 wherein said side edge sensing means comprises a third sheet sensor for sensing the sheet side edge.

21. The combination sheet deskew and side registration apparatus of claim 13 and including operator adjustable means for varying said selective controlling of said drive means by said control means.

22. The combination sheet deskew and side registration apparatus of claim 13 wherein said drive means comprises a plurality of sets of at least two independently controllable and spaced apart sheet drivers, said plurality of sets of sheet drivers selectably controllable by said control means for driving said sheet differentially and non-differentially.

23. A method of combined sheet deskew and side registration comprising the ordered steps of:

feeding in a process direction a sheet with an initial random skew of unknown magnitude and direction into engagement with a sheet driver including at least two spaced apart independently controllable sheet drivers for selectively providing differential and non-differential driving of said sheet;

driving said sheet non-differentially in only said process direction with said sheet driver until said sheet reaches an initial skew sensing means including spaced apart first and second sheet sensors;

measuring said initial random skew of said sheet with said initial skew sensing means;

driving said sheet differentially with said sheet driver to both compensate for said initial random skew and induce a known alignment skew of a fixed magnitude and direction;

driving said sheet non-differentially in only said process direction with said sheet driver until said sheet reaches side edge sensing means including a third sheet sensor removed from said initial skew sensing means;

driving said sheet differentially with said sheet driver to compensate for said alignment skew so that said sheet is deskewed and side registered to a lateral position transverse to said process direction; and driving said sheet non-differentially in said process direction with said sheet driver.

24. A method of combined sheet deskew and side registration in a deskewing and side registration arrangement, including a sheet path; two spaced apart sheet drivers, each sheet driver differentially drivable by one of first and second sheet driver motors, said sheet driver motors controllably driven by a controller delivering control pulses to said sheet driver motors; and first, second and third sensors, said first and second sensors comprising an initial sheet skew detector, and said third sheet sensor comprising a sheet side edge detector; the method comprising the ordered steps of:

advancing a sheet non-differentially along said sheet path with said sheet drivers;

detecting the lead edge of said sheet with one of said first and second sensors;

counting control pulses from said controller until said lead edge is detected by said other of said first and second sensor to derive an initial skew sheet skew measurement of direction and magnitude measured in control pulses;

advancing said sheet along said sheet path with said sheet drivers differentially by delivering a differential number of control pulses to said first and second sheet driver motors, said differential number equal to the initial skew measurement plus the number of control pulses required to skew the sheet to a selected alignment skew;

advancing the sheet non-differentially along the sheet path with said sheet drivers, maintaining said alignment skew until said third sensor, removed from said first and second sensors, detects the sheet side edge;

advancing said sheet differentially along the sheet path with said sheet drivers by delivering a differential number of control pulses to said first and second sheet driver motors, said differential number equal to the the number of control pulses required to deskew the sheet from the selected alignment skew;

advancing a sheet non-differentially along said sheet path with said sheet drivers.

* * * * *